US009062266B2

(12) United States Patent
Peretolchin et al.

(10) Patent No.: US 9,062,266 B2
(45) Date of Patent: Jun. 23, 2015

(54) IMIDAZOLIUM SALTS AS ADDITIVES FOR FUELS

(71) Applicants: Maxim Peretolchin, Lambrecht (DE); Ludwig Voelkel, Limburgerhof (DE); Harald Boehnke, Mannheim (DE); Markus Hansch, Speyer (DE); Boris Gaspar, Mannheim (DE); Christian Seitz, Heidelberg (DE)

(72) Inventors: Maxim Peretolchin, Lambrecht (DE); Ludwig Voelkel, Limburgerhof (DE); Harald Boehnke, Mannheim (DE); Markus Hansch, Speyer (DE); Boris Gaspar, Mannheim (DE); Christian Seitz, Heidelberg (DE)

(73) Assignee: BASF SE, Ludwigshafen (DE)

( * ) Notice: Subject to any disclaimer, the term of this patent is extended or adjusted under 35 U.S.C. 154(b) by 50 days.

(21) Appl. No.: 13/761,644

(22) Filed: Feb. 7, 2013

(65) Prior Publication Data

US 2013/0205654 A1 Aug. 15, 2013

Related U.S. Application Data

(60) Provisional application No. 61/597,191, filed on Feb. 10, 2012.

(51) Int. Cl.

| | |
|---|---|
| ***C10L 10/18*** | (2006.01) |
| ***C10L 1/22*** | (2006.01) |
| ***C10L 1/224*** | (2006.01) |
| ***C10L 1/232*** | (2006.01) |
| ***C10L 10/14*** | (2006.01) |

(52) U.S. Cl.
CPC ..... *C10L 1/232* (2013.01); *C10L 10/18* (2013.01); *C10L 10/14* (2013.01)

(58) Field of Classification Search
USPC ..... 44/432, 342, 345
See application file for complete search history.

(56) References Cited

U.S. PATENT DOCUMENTS

| | | | | |
|---|---|---|---|---|
| 3,121,091 | A * | 2/1964 | Green | 514/396 |
| 3,150,147 | A * | 9/1964 | Udelhofen | 548/350.1 |
| 3,259,477 | A * | 7/1966 | Udelhofen | 44/345 |
| 3,506,712 | A | 4/1970 | Capowski et al. | |
| 4,108,858 | A | 8/1978 | Malec | |
| 4,491,455 | A | 1/1985 | Ishizaki et al. | |
| 4,849,572 | A | 7/1989 | Chen et al. | |
| 4,877,416 | A | 10/1989 | Campbell | |
| 6,743,266 | B2 | 6/2004 | DeRosa et al. | |
| 6,896,708 | B2 * | 5/2005 | Connor et al. | 44/451 |
| 2003/0056431 | A1 * | 3/2003 | Schwab et al. | 44/419 |
| 2009/0145392 | A1 * | 6/2009 | Clark et al. | 123/1 A |
| 2009/0288992 | A1 * | 11/2009 | Victorovna Likhanova et al. | 208/237 |
| 2011/0258917 | A1 | 10/2011 | Garcia Castro et al. | |
| 2011/0315107 | A1 | 12/2011 | Grabarse et al. | |
| 2012/0137573 | A1 | 6/2012 | Voelkel et al. | |
| 2012/0149617 | A1 | 6/2012 | Lange et al. | |

FOREIGN PATENT DOCUMENTS

| | | | |
|---|---|---|---|
| DE | 38 26 608 | A1 | 2/1990 |
| DE | 38 38 918 | A1 | 5/1990 |
| DE | 41 42 241 | A1 | 6/1993 |
| DE | 43 09 074 | A1 | 9/1994 |
| DE | 196 20 262 | A1 | 11/1997 |
| DE | 101 02 913 | A1 | 7/2002 |
| EP | 0 061 895 | A2 | 10/1982 |
| EP | 0 244 616 | A2 | 11/1987 |
| EP | 0 261 957 | A2 | 3/1988 |
| EP | 0 307 815 | A1 | 3/1989 |
| EP | 0 310 875 | A1 | 4/1989 |
| EP | 0 356 725 | A1 | 3/1990 |
| EP | 0 476 485 | A1 | 3/1992 |
| EP | 0 548 617 | A2 | 6/1993 |
| EP | 0 639 632 | A1 | 2/1995 |
| EP | 0 452 328 | B1 | 4/1995 |
| EP | 0 700 985 | A1 | 3/1996 |
| EP | 0 831 141 | A1 | 3/1998 |
| GB | 958160 | * | 6/1964 |
| WO | 87/01126 | | 2/1987 |
| WO | 93/18115 | | 9/1993 |
| WO | 94/24231 | | 10/1994 |
| WO | 96/03367 | | 2/1996 |

(Continued)

OTHER PUBLICATIONS

U.S. Appl. 13/535,847, filed Jun. 28, 2012, Cornelia Roeger-Goepfert, et al.

(Continued)

*Primary Examiner* — Pamela H Weiss
(74) *Attorney, Agent, or Firm* — Oblon, McClelland, Maier & Neustadt, L.L.P.

(57) ABSTRACT

The use of imidazolium salts (I)

(I)

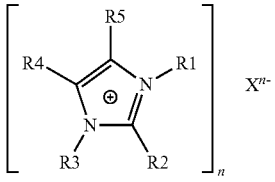

where R1 and R3 are each independently an organic radical having 1 to 3000 carbon atoms,
R2, R4 and R5 are each independently hydrogen or an organic radical having 1 to 3000 carbon atoms,
X is an anion and
n is the number 1, 2 or 3
as additives for fuels, especially as detergent additives for diesel fuels, as wax antisettling additives for middle distillate fuels and as lubricity improvers, and for improving the use properties of mineral and synthetic nonaqueous industrial fluids.

18 Claims, No Drawings

(56) References Cited

FOREIGN PATENT DOCUMENTS

| | | | |
|---|---|---|---|
| WO | 96/03479 | | 2/1996 |
| WO | 97/03946 | | 2/1997 |
| WO | 98/04656 | | 2/1998 |
| WO | 99/29748 | | 6/1999 |
| WO | 00/44857 | | 8/2000 |
| WO | 00/47698 | | 8/2000 |
| WO | 2004/035715 | A1 | 4/2004 |
| WO | 2005/054314 | A2 | 6/2005 |
| WO | WO 2006/090819 | A1 | 8/2006 |
| WO | WO 2006111712 | A2 * | 10/2006 |
| WO | 2010/096168 | A1 | 8/2010 |
| WO | 2010/101801 | A1 | 9/2010 |
| WO | 2012/004300 | A1 | 1/2012 |
| WO | 2012/076428 | A1 | 6/2012 |

OTHER PUBLICATIONS

International Search Report issued Jun. 18, 2013 in PCT/EP2013/052373 with English Translation.

Zheng Guo et al., "Predictions of Flavonoid Solubility in Ionic Liquids by COSMO-RS: Experimental Verification, Structural Elucidation, and Solvation Characterization", Database CA [Online], Chemical Abstracts Service, XP-002696586, Database Accession No. 2007:1335991, 2007, 3 pages.

Yamei Zhao et al., "Preparation of Polysulfone Membranes Using Ionic Liquid [C16mim] [SCN] as a Pore-former and Plasticizer", Database CA [Online], Chemical Abstracts Service, XP-002696587, Database Accession No. 2010:301473, 2010, 2 pages.

Feng Shi et al., "The First Non-acid Catalytic Synthesis of Tert-butyl Ether from Tert-butyl Alcohol using Ionic Liquid as Dehydrator", Database CA [Online], Chemical Abstracts Service, XP-002696588, Database Accession No. 2003:295835, 2003, 2 pages.

Gilles Kohnen et al., "Counterion Effects on the Mesomorphic Properties of Chiral Imidazolium and Pyridinium Ionic Liquids", Database CA [Online], Chemical Abstracts Service, XP-002696589, Database Accession No. 2009:1345610, 2009, 2 pages.

Haw-Lih Su, "*N*-heterocyclic Carbene Metal Complexes: Synthesis, Kinetics, Reactivity, and Recycling with Polymers", Dissertation, XP-002696590, Aug. 2011, 6 pages.

U.S. Appl. No. 13/898,766, filed May 21, 2013, Peretolchin, et al.

U.S. Appl. No. 13/787,708, filed Mar. 4, 2013, Strittmatter, et al.

U.S. Appl. No. 13,781,929, filed Mar. 1, 2013, Strittmatter, et al.

U.S. Appl. No. 13/866,291, filed Apr. 19, 2013, Boehnke.

* cited by examiner

IMIDAZOLIUM SALTS AS ADDITIVES FOR FUELS

The present invention relates to the use of imidazolium salts as additives for fuels, especially as detergent additives for diesel fuels, in particular for those diesel fuels which are combusted in direct injection diesel engines, especially in common rail injection systems. The present invention further relates to an additive concentrate and to a fuel composition comprising such imidazolium salts. The present invention further relates to novel imidazolium salts and to the use thereof in industrial fluids.

In direct injection diesel engines, the fuel is injected and distributed ultrafinely (nebulized) by a multihole injection nozzle which reaches directly into the combustion chamber of the engine, instead of being introduced into a prechamber or swirl chamber as in the case of the conventional (chamber) diesel engine. The advantage of the direct injection diesel engines lies in their high performance for diesel engines and nevertheless low fuel consumption. Moreover, these engines achieve a very high torque even at low speeds.

At present, essentially three methods are being used for injection of the fuel directly into the combustion chamber of the diesel engine: the conventional distributor injection pump, the pump-nozzle system (unit-injector system or unit-pump system), and the common rail system.

In the common rail system, the diesel fuel is conveyed by a pump with pressures up to 2000 bar into a high-pressure line, the common rail. Proceeding from the common rail, branch lines run to the different injectors which inject the fuel directly into the combustion chamber. The full pressure is always applied to the common rail, which enables multiple injection or a specific injection form. In the other injection systems, in contrast, only a smaller variation in the injection is possible. The injection in the common rail is divided essentially into three groups: (1.) pre-injection, by which essentially softer combustion is achieved, such that harsh combustion noises ("nailing") are reduced and the engine seems to run quietly; (2.) main injection, which is responsible especially for a good torque profile; and (3.) post-injection, which especially ensures a low $NO_x$ value. In this post-injection, the fuel is generally not combusted, but instead vaporized by residual heat in the cylinder. The exhaust gas/fuel mixture formed is transported to the exhaust gas system, where the fuel, in the presence of suitable catalysts, acts as a reducing agent for the nitrogen oxides NOR.

The variable, cylinder-individual injection in the common rail injection system can positively influence the pollutant emission of the engine, for example the emission of nitrogen oxides ($NO_x$), carbon monoxide (CO) and especially of particulates (soot). This makes it possible, for example, for engines equipped with common rail injection systems to meet the Euro 4 standard theoretically even without additional particulate filters.

In modern common rail diesel engines, under particular conditions, for example when biodiesel-containing fuels or fuels with metal impurities such as zinc compounds, copper compounds, lead compounds and other metal compounds are used, deposits can form on the injector orifices, which adversely affect the injection performance of the fuel and hence impair the performance of the engine, i.e. especially reduce the power, but in some cases also worsen the combustion. The formation of deposits is enhanced further by further developments in the injector construction, especially by the change in the geometry of the nozzles (narrower, conical orifices with rounded outlet). For lasting optimal functioning of engine and injectors, such deposits in the nozzle orifices must be prevented or reduced by suitable fuel additives.

International application WO 2012/004300 (1) describes acid-free quaternized nitrogen compounds as fuel additives, which are obtainable by addition of a compound comprising at least one oxygen- or nitrogen-containing group reactive with an anhydride and additionally at least one quaternizable amino group onto a polycarboxylic anhydride compound and subsequent quaternization with an epoxide in the absence of free acid. Suitable compounds having an oxygen- or nitrogen-containing group reactive with an anhydride and additionally a quaternizable amino group are especially polyamines having at least one primary or secondary amino group and at least one tertiary amino group. Useful polycarboxylic anhydrides include especially dicarboxylic acids such as succinic acid with a relatively long-chain hydrocarbyl substituent. Such a quaternized nitrogen compound is, for example, the reaction product, obtained at 40° C., of polyisobutenylsuccinic anhydride with 3-(dimethylamino)propylamine, which is a polyisobutenylsuccinic monoamide and which is subsequently quaternized with styrene oxide in the absence of free acid at 70° C. Such acid-free quaternized nitrogen compounds are especially suitable as a fuel additive for reducing or preventing deposits in the injection systems of direct injection diesel engines, especially in common rail injection systems, for reducing the fuel consumption of direct injection diesel engines, especially of diesel engines with common rail injection systems, and/or for minimizing power loss in direct injection diesel engines, especially in diesel engines with common rail injection systems.

International application PCT/EP2011/071683 (2) describes polytetrahydrobenzoxazines and bistetrahydrobenzoxazines as fuel additives, which are obtainable by, in a first reaction step, gradually reacting a $C_1$- to $C_{20}$-alkylenediamine having two primary amino functions, e.g. 1,2-ethylenediamine, with a $C_1$- to $C_{12}$-aldehyde, e.g. formaldehyde, and a $C_1$- to $C_8$-alkanol at a temperature of 20 to 80° C. with elimination and removal of water, both the aldehyde and the alcohol being used in more than twice the molar amount relative to the diamine, reacting the condensation product thus obtained in a second reaction step with a phenol which bears at least one long-chain substituent, for example a tert-octyl, n-nonyl, n-dodecyl or polyisobutyl radical, in a stoichiometric ratio of the alkylenediamine originally used of 1.2:1 to 3:1 at a temperature of 30 to 120° C. and optionally heating the bistetrahydrobenzoxazine thus obtained in a third reaction step to a temperature of 125 to 280° C. for at least 10 minutes. Such polytetrahydrobenzoxazines and bistetrahydrobenzoxazines are especially suitable as a fuel additive for reducing or preventing deposits in the injection systems of direct injection diesel engines, especially in common rail injection systems, for reducing the fuel consumption of direct injection diesel engines, especially of diesel engines with common rail injection systems, and/or for minimizing power loss in direct injection diesel engines, especially in diesel engines with common rail injection systems.

However, the acid-free quaternized nitrogen compounds and polytetrahydrobenzoxazines or bistetrahydrobenzoxazines mentioned are still in need of improvement in terms of their properties as detergent additives for fuels. In addition, they should also have improved anticorrosive action, improved motor oil compatibility and improved low-temperature properties.

It was therefore an object of the present invention to provide improved fuel additives which no longer have the disadvantages detailed from the prior art.

Accordingly, the use of imidazolium salts of the general formula (I)

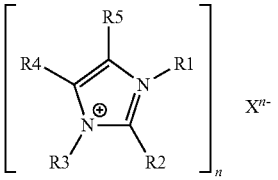

(I)

in which the variables R1 and R3 are each independently an organic radical having 1 to 3000 carbon atoms, the variables R2, R4 and R5 are each independently hydrogen or an organic radical having 1 to 3000 carbon atoms, X is an anion and n is the number 1, 2 or 3 as additives for fuels has been found.

Imidazolium salts of the (I) type—as well as, for example, open-chain quaternary ammonium salts, pyridinium salts, pyridazinium salts, pyrimidinium salts, pyrazinium salts, pyrazolium salts, pyrazolinium salts, imidazolinium salts, thiazolium salts, triazolium salts, pyrrolidinium salts and imidazolidinium salts—are among what are known as ionic liquids, which are understood to mean salts (i.e. compounds composed of cations and anions) which, at standard pressure, have a melting point of less than 200° C., usually even of less than 80° C. Ionic liquids often comprise an organic compound as a cation (organic cation). According to the valency of the anion, the ionic liquid may, as well as the organic cation, comprise further cations such as metal cations.

Imidazolium salts of the (I) type are known in their application as detergents or dispersants in lubricant formulations. For instance, WO 2010/101801 A1 (3) describes oil-soluble ionic detergents as additive components in lubricant oils for internal combustion engines; examples cited are, as well as open-chain ionic systems and quaternized pyridinium detergents, quaternized imidazolium phenoxides, imidazolium chlorides and imidazolium salicylates.

WO 2010/096168 A1 (4) describes ionic liquids such as pyridinium salts as additives for control of deposit formation on the internal surfaces of internal combustion engines. In contrast to the present invention, however, such additives are added to the lubricant oil and not to the fuel used to operate these engines. Moreover, WO 2010/096168 A1 explicitly does not disclose imidazolium salts as such additives.

U.S. Pat. No. 4,108,858 (5) discloses high molecular weight N-hydrocarbyl-substituted quaternized ammonium salts with a molecular weight of 350 to 3000 carbon atoms for the hydrocarbyl group as detergents and dispersants for fuels such as gasoline fuels and diesel fuels and for lubricant oils. Specified as such high molecular weight N-hydrocarbyl-substituted quaternized ammonium salts are, as well as open-chain systems, salts of piperidines, piperazines, morpholines and pyridines. Useful relatively long-chain hydrocarbyl radicals include, for example, polybutene or polypropylene radicals.

In a preferred embodiment of the present invention, the imidazolium salts (I) are used as detergent additives for diesel fuels. In this embodiment, particular preference is given to the individual uses of the imidazolium salts (I) as an additive for reducing or preventing deposits in the injection systems of direct injection diesel engines, especially in common rail injection systems, for reducing the fuel consumption of direct injection diesel engines, especially of diesel engines with common rail injection systems, and/or for minimizing power loss in direct injection diesel engines, especially in diesel engines with common rail injection systems.

In a further preferred embodiment embodiment, the imidazolium salts (I) are used as a wax antisettling additive (WASA) for middle distillate fuels, especially diesel fuels.

In a further preferred embodiment, the imidazolium salts (I) are used as a lubricity improver for fuels, especially as friction modifiers for gasoline fuels and as lubricity additives for middle distillate fuels or diesel fuels.

The organic radicals for the variables R1 to R5 in the imidazolium salts of the general formula (I) comprise preferably 1 to 1000, especially 1 to 500 and in particular 1 to 250 carbon atoms. In general, these organic radicals are low molecular weight radicals, for example alkyl, cycloalkyl, alkenyl, cycloalkenyl, aryl or heteroaryl radicals, or polymeric radicals, for example polypropyl radicals or especially polyisobutyl radicals. Low molecular weight radicals comprise preferably 1 to 20 carbon atoms.

Useful organic radicals having 1 to 3000 carbon atoms for the variables R1 to R5 in the imidazolium salts of the general formula (I) preferably include $C_1$- to $C_{20}$-alkyl radicals, especially $C_1$- to $C_{12}$-alkyl radicals, in particular $C_1$- to $C_{20}$-alkyl radicals, and the aryl-, heteroaryl-, cycloalkyl-, halogen-, hydroxy-, amino-, carboxy-, formyl-, —O—, —CO—, —CO—O— or —CO—N<-substituted components thereof, for example methyl, ethyl, 1-propyl, 2-propyl, 1-butyl, 2-butyl, 2-methyl-1-propyl(isobutyl), 2-methyl-2-propyl(tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, n-heptyl, n-octyl, 2-ethylhexyl, n-nonyl, n-decyl, 2-propylheptyl, n-undecyl, n-dodecyl, n-tridecyl, isotridecyl, n-tetradecyl, n-pentadecyl, n-hexadecyl, n-heptadecyl, n-octadecyl, n-nonadecyl, n-eicosyl, phenylmethyl(benzyl), diphenylmethyl, triphenylmethyl, 2-phenylethyl, 3-phenylpropyl, cyclopentylmethyl, 2-cyclopentylethyl, 3-cyclopentylpropyl, cyclohexylmethyl, 2-cyclohexylethyl, 3-cyclohexylpropyl, methoxy, ethoxy, formyl, acetyl, and also fluoroalkyl radicals such as monofluoromethyl, difluoromethyl, trifluoromethyl, pentafluoroethyl, 3,3,3-trifluoropropyl, perfluorohexyl, perfluorooctyl, perfluorodecyl or perfluorododecyl.

Further suitable organic radicals having 1 to 20 carbon atoms for variables R1 to R5 in the imidazolium salts of the general formula (I) are also $C_3$- to $C_{12}$-cycloalkyl radicals, especially $C_5$- to $C_7$-cycloalkyl radicals, and the aryl-, heteroaryl-, cycloalkyl-, halogen-, hydroxy-, amino-, carboxy-, formyl-, —O—, —CO— or —CO—O-substituted components thereof, for example cyclopentyl, 2-methyl-1-cyclopentyl, 3-methyl-1-cyclopentyl, cyclohexyl, 2-methyl-1-cyclohexyl, 3-methyl-1-cyclohexyl, 4-methyl-1-cyclohexyl, and also fluorocyclohexyl radicals such as perfluorocyclohexyl.

Further suitable organic radicals having 1 to 20 carbon atoms for variables R1 to R5 in the imidazolium salts of the general formula (I) are also $C_2$- to $C_{20}$-alkenyl radicals, especially $C_3$- to $C_8$-alkenyl radicals, and the aryl-, heteroaryl-, cycloalkyl-, halogen-, hydroxy-, amino-, carboxy-, formyl-, —O—, —CO— or —CO—O-substituted components thereof, for example vinyl, 2-propenyl(allyl), 3-butenyl, cis- 2-butenyl, trans-2-butenyl, and also fluoroalkenyl radicals such as perfluoro-2-propenyl, perfluoro-3-butenyl or perfluoro-2-butenyls.

Further suitable organic radicals having 1 to 20 carbon atoms for variables R1 to R5 in the imidazolium salts of the general formula (I) are also $C_3$- to $C_{12}$-cycloalkenyl radicals, especially $C_5$- to $C_7$-cycloalkenyl radicals, and the aryl-, heteroaryl-, cycloalkyl-, halogen-, hydroxy-, amino-, carboxy-, formyl-, —O—, —CO— or —CO—O-substituted components thereof, for example 3-cyclopentenyl, 2-cyclohexenyl, 3-cyclohexenyl, 2,5-cyclohexadienyl, and also fluorocycloalkenyl radicals such as fluorocyclohexenyl radicals.

Further suitable organic radicals having 1 to 20 carbon atoms for variables R1 to R5 in the imidazolium salts of the general formula (I) are also aryl or heteroaryl radicals having 3 to 20 and especially 5 to 10 carbon atoms and the alkyl-, aryl-, heteroaryl-, cycloalkyl-, halogen-, hydroxy-, amino-, carboxy-, formyl-, —O—, —CO— or —CO—O-substituted components thereof, for example phenyl, 2-methylphenyl (2-tolyl), 3-methylphenyl (3-tolyl), 4-methylphenyl (4-tolyl), 2-ethylphenyl, 3-ethylphenyl, 4-ethylphenyl, 2,3-dimethylphenyl, 2,4-dimethylphenyl, 2,5-dimethylphenyl, 2,6-dimethylphenyl, 3,4-dimethylphenyl, 3,5-dimethylphenyl, 4-phenylphenyl, 1-naphthyl, 2-naphthyl, 1-pyrrolyl, 2-pyrrolyl, 3-pyrrolyl, 2-pyridinyl, 3-pyridinyl, 4-pyridinyl, and also fluoroaryl or fluoroheteroaryl radicals such as mono-, di-, tri-, tetra- or pentafluorophenyl.

It is also possible for two adjacent radicals of the variables R1 to R5 to form an unsaturated, saturated or aromatic ring which may optionally be substituted by functional groups, aryl, alkyl, aryloxy, alkyloxy, halogen, heteroatoms and/or heterocycles and may optionally be interrupted by one or more oxygen and/or sulfur atoms and/or one or more substituted or unsubstituted imino groups.

The organic radicals having 1 to 3000 carbon atoms for the variables R1 to R5 may be synthetic radicals or—especially in the case of alkyl and alkenyl radicals—radicals based on naturally occurring compounds. The latter derive particularly from naturally occurring glycerides or fatty acids, for example from stearic acid, palmitic acid, oleic acid, linoleic acid, linolenic acid or tallow fatty acid. Such radicals based on naturally occurring compounds are often mixtures of different, usually homologous alkyl or alkenyl radicals.

Further preferred organic radicals having 1 to 3000 carbon atoms for the variables R1 to R5 in the imidazolium salts of the general formula (I) also include polyisobutyl radicals having 16 to 3000, especially having 20 to 1000, in particular having 25 to 500 and most preferably having 30 to 250 carbon atoms. Such polyisobutyl radicals have number-average molecular weights $M_n$, determined by gel permeation chromatography, of 200 to 40 000, preferably of 500 to 15 000, especially of 700 to 7000, in particular of 900 to 3000 and most preferably of 900 to 1100. The polyisobutyl radicals may be joined to the imidazolium ring directly or by a methylene group (—$CH_2$—).

The organic radicals having 1 to 3000 carbon atoms for the variables R1 to R5, especially the alkyl, cycloalkyl, alkenyl, cycloalkenyl, aryl and heteroaryl radicals mentioned, and also the polymeric radicals mentioned, may comprise one or more heteroatoms in their skeletons, such as oxygen atoms, sulfur atoms, or nitrogen atoms optionally substituted by further, usually low molecular weight organic radicals, or bear one or more substituents or one or more functional groups, for example hydroxyl groups, halogen atoms such as fluorine, chlorine or bromine, pseudohalide groups such as thiocyanato or dicyanamido, cyano groups, nitro groups, sulfo groups, sulfonic acid groups, sulfonic ester groups, sulfonamide groups, amino groups, carboxylic acid groups, carboxylic ester groups or carboxamide groups.

In general, imidazolium salts of the general formula (I) in which the variables R1 and R3 each have the above definitions of an organic radical having 1 to 3000 carbon atoms and the variables R2, R4 and R5 are each hydrogen are used.

In a preferred embodiment of the present invention, imidazolium salts of the general formula (I) in which the variables R1 and R3 are each independently $C_1$- to $C_{20}$-alkyl groups, $C_2$- to $C_{20}$-alkenyl groups and/or polyisobutyl radicals having a number-average molecular weight ($M_n$) of 200 to 40 000 and the variables R2, R4 and R5 are each hydrogen are used. These $C_1$- to $C_{20}$-alkyl groups are preferably pure hydrocarbyl radicals. Typical examples of such pure $C_1$- to $C_{20}$-hydrocarbyl radicals are the 2-ethylhexyl and tallow fatty alkyl radicals.

Useful anions X in the imidazolium salts of the general formula (I) include, for example: chloride; bromide, iodide; thiocyanate; hexafluorophosphate; trifluoromethanesulfonate; methanesulfonate; carboxylates, especially formate, acetate, propionate, butyrate or benzoate; mandelate; nitrate; nitrite; trifluoroacetate; sulfate; hydrogensulfate; methylsulfate; ethylsulfate; 1-propylsulfate; 1-butylsulfate; 1-hexylsulfate; 1-octylsulfate; phosphate; dihydrogenphosphate; hydrogenphosphate; $C_1$-$C_4$-dialkylphosphates; propionate; tetrachloroaluminate; $Al_2Cl_7^-$; chlorozincate; chloroferrate; bis(trifluoromethylsulfonyl)imide; bis(pentafluoroethylsulfonyl)imide; bis(methylsulfonyl)imide; bis(p-tolylsulfonyl)imide; tris(trifluoromethylsulfonyl)methide; bis(pentafluoroethylsulfonyl)methide; p-tolylsulfonate; tetracarbonylcobaltate; dimethyleneglycolmonomethylethersulfate; oleate; stearate; acrylate; methacrylate; maleate; hydrogencitrate; vinylphosphonate; bis(pentafluoroethyl)phosphinate; borates such as bis[salicylato(2-)]borate, bis[oxalato(2-)]borate, bis[1,2-benzenediolato(2-)-O, O']borate, tetracyanoborate or tetrafluoroborate; dicyanamide; tris(pentafluoroethyl)trifluorophosphate; tris(heptafluoropropyl)trifluorophosphate, cyclic arylphosphates such as pyrocatecholphosphate of the formula $(C_6H_4O_2)P(O)O$—; chlorocobaltate.

In general, the anions X are selected from the following group:

- alkylsulfates of the formula $R^aOSO_3^-$ where $R^a$ is a $C_1$- to $C_{12}$-alkyl group, preferably a $C_1$- to $C_8$-alkyl group;
- the alkylsulfonates of the formula $R^aSO_3^-$ where $R^a$ is a $C_1$- to $C_{12}$-alkyl group, preferably a $C_1$- to $C_8$-alkyl group;
- halides, especially chloride and bromide;
- pseudohalides, especially thiocyanate and dicyanamide;
- carboxylates of the formula $R^aCOO^-$ where $R^a$ is a $C_1$— to $C_{60}$-alkyl group, a $C_2$- to $C_{60}$-alkenyl group, a $C_6$- to $C_{60}$-aryl group or a $C_7$- to $C_{60}$-alkylaryl or -arylalkyl group, preferably a $C_1$- to $C_{20}$-alkyl group, a $C_2$- to $C_{20}$-alkenyl group, a $C_6$- to $C_{20}$-aryl group or a $C_7$- to $C_{20}$-alkylaryl or arylalkyl group, in particular a $C_2$- to $C_8$-alkenyl group, a $C_6$- to $C_{12}$-aryl group or a $C_7$- to $C_{14}$-alkylaryl or -arylalkyl group, especially acetate, but also formate, propionate, butyrate, acrylate, methacrylate, benzoate, phenylacetate or o-, m- or p-methylbenzoate;
- polycarboxylates of the formula $R^b(COO^-)_n$ where n is the number 1, 2 or 3 and $R^n$ is an n-valent hydrocarbyl radical having 1 to 60, especially 1 to 20 and in particular 1 to 14 carbon atoms; typical radicals of this kind are malonate, succinate, glutarate, adipate, phthalate or terephthalate; a further suitable polycarboxylate anion is also the oxalate anion —OOC—COO$^-$;

phosphates, especially dialkylphosphates of the formula $R^aR^bPO_4^-$ where $R^a$ and $R^b$ are each independently a $C_1$- to $C_6$-alkyl group; more particularly, $R^a$ and $R^b$ are each the same alkyl group as in dimethylphosphate and diethylphosphate;

phosphonates, especially monoalkyl phosphonates of the formula $R^aR^bPO_3^-$ where $R^a$ and $R^b$ are each independently a $C_1$- to $C_6$-alkyl group;

the TFSI anion of the formula $N(SO_2CF_3)_2^-$;

tricyanomethanide of the formula $(CN)_3C^-$.

Frequently selected anions X are chloride, bromide, hydrogensulfate, tetrachloroaluminate, thiocyanate, dicyanamide, methylsulfate, ethylsulfate, methanesulfonate, formate, acetate, dimethylphosphate, diethylphosphate, p-tolylsulfonate, tetrafluoroborate, hexafluorophosphate, methylmethylphosphonate, methylphosphonate, the TFSI anion, tricyanomethanide and trifluoromethanesulfonate.

In a preferred embodiment of the present invention, imidazolium salts of the general formula (I) in which the anion X denotes sulfate, an alkylsulfate, an alkylsulfonate, an alkylcarbonate, a halide, a pseudohalide, a carboxylate, a phosphate, a phosphonate, nitrate, nitrite, the TFSI anion of the formula $N(SO_2CF_3)_2^-$ or the tricyanomethanide anion are used. The anion X is most preferably an alkylcarbonate, a pseudohalide, a carboxylate or the tricyanomethanide anion. It is frequently also advantageous when the anion X does not comprise any phosphorus atom, any sulfur atom, any halogen atom and/or any boron atom.

The charge n of the anion X depends on its nature and may assume the value of 1, 2 or 3. n is most frequently 1 or 2, especially 1.

Typical individual examples of imidazolium salts (I) are 1,3-dimethylimidazolium acetate, 1,3-diethylimidazolium acetate, 1-ethyl-3-methylimidazolium acetate, 1-propyl-3-methylimidazolium acetate, 1-butyl-3-methylimidazolium acetate, 1-pentyl-3-methylimidazolium acetate, 1-hexyl-3-methylimidazolium acetate, 1-octyl-3-methylimidazolium acetate, 1-(2-ethylhexyl)-3-methylimidazolium acetate, 1,3-di(2-ethylhexyl)imidazolium acetate, 1-decyl-3-methylimidazolium acetate, 1-(2-propylheptyl)-3-methylimidazolium acetate, 1,3,4,5-tetramethylimidazolium acetate, 1,3-dimethyl-4,5-diphenylimidazolium acetate, 1,4,5-trimethyl-3-ethylimidazolium acetate, 1-methyl-3-ethyl-4,5-diphenylimidazolium acetate, 1,3-dimethylimidazolium methylcarbonate, 1,3-diethylimidazolium methylcarbonate, 1-ethyl-3-methylimidazolium methylcarbonate, 1-propyl-3-methylimidazolium methylcarbonate, 1-butyl-3-methylimidazolium methylcarbonate, 1-pentyl-3-methylimidazolium methylcarbonate, 1-hexyl-3-methylimidazolium methylcarbonate, 1-octyl-3-methylimidazolium methylcarbonate, 1-(2-ethylhexyl)-3-methylimidazolium methylcarbonate, 1,3-di(2-ethylhexyl)imidazolium methylcarbonate, 1-decyl-3-methylimidazolium methylcarbonate, 1-(2-propylheptyl)-3-methylimidazolium methylcarbonate, 1,3,4,5-tetramethylimidazolium methylcarbonate, 1,3-dimethyl-4,5-diphenylimidazolium methylcarbonate, 1,4,5-trimethyl-3-ethylimidazolium methylcarbonate, 1-methyl-3-ethyl-4,5-diphenylimidazolium methylcarbonate, 1,3-dimethylimidazolium methylsulfate, 1,3-diethylimidazolium methylsulfate, 1-ethyl-3-methylimidazolium methylsulfate, 1-propyl-3-methylimidazolium methylsulfate, 1-butyl-3-methylimidazolium methylsulfate, 1-pentyl-3-methylimidazolium methylsulfate, 1-hexyl-3-methylimidazolium methylsulfate, 1-octyl-3-methylimidazolium methylsulfate, 1-(2-ethylhexyl)-3-methylimidazolium methylsulfate, 1,3-di(2-ethylhexyl)imidazolium methylsulfate, 1-decyl-3-methylimidazolium methylsulfate, 1-(2-propylheptyl)-3-methylimidazolium methylsulfate, 1,3,4,5-tetramethylimidazolium methylsulfate, 1,3-dimethyl-4,5-diphenylimidazolium methylsulfate, 1,4,5-trimethyl-3-ethylimidazolium methylsulfate, 1-methyl-3-ethyl-4,5-diphenylimidazolium methylsulfate, 1,3-dimethylimidazolium methylsulfonate, 1,3-diethylimidazolium methylsulfonate, 1-ethyl-3-methylimidazolium methylsulfonate, 1-propyl-3-methylimidazolium methylsulfonate, 1-butyl-3-methylimidazolium methylsulfonate, 1-pentyl-3-methylimidazolium methylsulfonate, 1-hexyl-3-methylimidazolium methylsulfonate, 1-octyl-3-methylimidazolium methylsulfonate, 1-(2-ethylhexyl)-3-methylimidazolium methylsulfonate, 1,3-di(2-ethylhexyl)imidazolium methylsulfonate, 1-decyl-3-methylimidazolium methylsulfonate, 1-(2-propylheptyl)-3-methylimidazolium methylsulfonate, 1,3,4,5-tetramethylimidazolium methylsulfonate, 1,3-dimethyl-4,5-diphenylimidazolium methylsulfonate, 1,4,5-trimethyl-3-ethylimidazolium methylsulfonate, 1-methyl-3-ethyl-4,5-diphenylimidazolium methylsulfonate, 1,3-dimethylimidazolium diethylphosphate, 1,3-diethylimidazolium diethylphosphate, 1-ethyl-3-methylimidazolium diethylphosphate, 1-propyl-3-methylimidazolium diethylphosphate, 1-butyl-3-methylimidazolium diethylphosphate, 1-pentyl-3-methylimidazolium diethylphosphate, 1-hexyl-3-methylimidazolium diethylphosphate, 1-octyl-3-methylimidazolium diethylphosphate, 1-(2-ethylhexyl)-3-methylimidazolium diethylphosphate, 1,3-di(2-ethylhexyl)imidazolium diethylphosphate, 1-decyl-3-methylimidazolium diethylphosphate, 1-(2-propylheptyl)-3-methylimidazolium diethylphosphate, 1,3,4,5-tetramethylimidazolium diethylphosphate, 1,3-dimethyl-4,5-diphenylimidazolium diethylphosphate, 1,4,5-trimethyl-3-ethylimidazolium diethylphosphate and 1-methyl-3-ethyl-4,5-diphenylimidazolium diethylphosphate.

Typical individual examples of imidazolium salts (I) with polyisobutenyl radicals are 1-polyisobutyl-3-methylimidazolium acetate, 1-polyisobutyl-3-ethylimidazolium acetate, 1-polyisobutyl-3-propylimidazolium acetate, 1-polyisobutyl-3-butylimidazolium acetate, 1-polyisobutyl-3-(2-ethylhexyl)imidazolium acetate, 1,3-di(polyisobutyl)imidazolium acetate, 1-polyisobutyl-3-methylimidazolium methylcarbonate, 1-polyisobutyl-3-ethylimidazolium methylcarbonate, 1-polyisobutyl-3-propylimidazolium methylcarbonate, 1-polyisobutyl-3-butylimidazolium methylcarbonate, 1-polyisobutyl-3-(2-ethylhexyl)imidazolium methylcarbonate, 1,3-di(polyisobutyl)imidazolium methylcarbonate, 1-polyisobutyl-3-methylimidazolium thiocyanate, 1-polyisobutyl-3-ethylimidazolium thiocyanate, 1-polyisobutyl-3-propylimidazolium thiocyanate, 1-polyisobutyl-3-butylimidazolium thiocyanate, 1-polyisobutyl-3-(2-ethylhexyl)imidazolium thiocyanate, 1,3-di(polyisobutyl)imidazolium thiocyanate, 1-polyisobutyl-3-methylimidazolium tricyanomethanide, 1-polyisobutyl-3-ethylimidazolium tricyanomethanide, 1-polyisobutyl-3-propylimidazolium tricyanomethanide, 1-polyisobutyl-3-butylimidazolium tricyanomethanide, 1-polyisobutyl-3-(2-ethylhexyl)imidazolium tricyanomethanide and 1,3-di(polyisobutyl)imidazolium tricyanomethanide.

Imidazolium salts of the (I) type with low molecular weight radicals are sold commercially under the Basionics™ name by BASF SE.

The preparation of the imidazolium salts of the (I) type is familiar to the person skilled in the art. A typical synthesis route proceeds from imidazole formation from 1 mol of a 1,2-dicarbonyl compound, 1 mol of an appropriately substituted primary amine, 1 mol of ammonia and 1 mol of an aldehyde, conducts an N-alkylation with a suitable alkylating agent and then, if desired, exchanges the anion. For example, glyoxal or benzil, a low molecular weight primary alkylamine or alkenylamine, for example a $C_1$- to $C_{13}$-alkylamine, or a polyisobutylamine, ammonia and formaldehyde are used to prepare an N-alkyl-4,5-diphenylimidazole or an N-alkylimidazole or an N-polyisobutyl-4,5-diphenylimidazole or an N-polyisobutylimidazole, and the unsubstituted second nitrogen atom is alkylated with an epoxide such as ethylene oxide, propylene oxide, butylene oxide or styrene oxide in the presence of acetic acid, or with a dialkyl carbonate, in which case the imidazolium salt has an acetate anion or an alkylcarbonate anion. To introduce a polyisobutyl radical on the unsubstituted second nitrogen atom, can with a polyisobutene epoxide as the alkylating agent be used.

In the preparation of imidazolium salts of the (I) type with the same variables R1 and R3, 1 mol of a 1,2-dicarbonyl compound is advantageously used together with 2 mol of an appropriately substituted primary amine and 1 mol of an aldehyde, optionally in the presence of a suitable solvent (for example of acetic acid and water when an imidazolium acetate is to be obtained) in a one-stage synthesis, usually at 20 to 120° C., especially at 25 to 80° C.

The fuel additized with one or more imidazolium salts (I) is a gasoline fuel or especially a middle distillate fuel, in particular a diesel fuel. The fuel may comprise further customary additives ("coadditives") to improve efficacy and/or suppress wear.

In the case of diesel fuels, these are primarily customary detergent additives, carrier oils, cold flow improvers, lubricity improvers, corrosion inhibitors, demulsifiers, dehazers, antifoams, cetane number improvers, combustion improvers, antioxidants or stabilizers, antistats, metallocenes, metal deactivators, dyes and/or solvents.

In the case of gasoline fuels, these are in particular lubricity improvers (friction modifiers), corrosion inhibitors, demulsifiers, dehazers, antifoams, combustion improvers, antioxidants or stabilizers, antistats, metallocenes, metal deactivators, dyes and/or solvents.

Typical examples of suitable coadditives are listed in the following sections:

The customary detergent additives are preferably amphiphilic substances which possess at least one hydrophobic hydrocarbyl radical with a number-average molecular weight ($M_n$) of 85 to 20 000 and at least one polar moiety selected from:

(Da) mono- or polyamino groups having up to 6 nitrogen atoms, at least one nitrogen atom having basic properties;

(Db) nitro groups, optionally in combination with hydroxyl groups;

(Dc) hydroxyl groups in combination with mono- or polyamino groups, at least one nitrogen atom having basic properties;

(Dd) carboxyl groups or the alkali metal or alkaline earth metal salts thereof;

(De) sulfonic acid groups or the alkali metal or alkaline earth metal salts thereof;

(Df) polyoxy-$C_2$- to $C_4$-alkylene moieties terminated by hydroxyl groups, mono- or polyamino groups, at least one nitrogen atom having basic properties, or by carbamate groups;

(Dg) carboxylic ester groups;

(Dh) moieties derived from succinic anhydride and having hydroxyl and/or amino and/or amido and/or imido groups; and/or (Di) moieties obtained by Mannich reaction of substituted phenols with aldehydes and mono- or polyamines.

The hydrophobic hydrocarbyl radical in the above detergent additives, which ensures the adequate solubility in the fuel, has a number-average molecular weight ($M_n$) of 85 to 20 000, preferably of 113 to 10 000, more preferably of 300 to 5000, even more preferably of 300 to 3000, even more especially preferably of 500 to 2500 and especially of 700 to 2500, in particular of 800 to 1500. Typical hydrophobic hydrocarbyl radicals especially include polypropenyl, polybutenyl and polyisobutenyl radicals with a number-average molecular weight $M_n$ of preferably in each case 300 to 5000, more preferably 300 to 3000, even more preferably 500 to 2500, even more especially preferably 700 to 2500 and especially 800 to 1500.

Examples of the above groups of detergent additives include the following:

Additives comprising mono- or polyamino groups (Da) are preferably polyalkenemono- or polyalkenepolyamines based on polypropene or on high-reactivity (i.e. having predominantly terminal double bonds) or conventional (i.e. having predominantly internal double bonds) polybutene or polyisobutene having $M_n$=300 to 5000, more preferably 500 to 2500 and especially 700 to 2500. Such additives based on high-reactivity polyisobutene, which can be prepared from the polyisobutene which may comprise up to 20% by weight of n-butene units by hydroformylation and reductive amination with ammonia, monoamines or polyamines such as dimethylaminopropylamine, ethylenediamine, diethylenetriamine, triethylenetetramine or tetraethylenepentamine, are known especially from EP-A 244 616. When polybutene or polyisobutene having predominantly internal double bonds (usually in the β and γ positions) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. For the amination, it is possible here to use amines such as ammonia, monoamines or the above-mentioned polyamines. Corresponding additives based on polypropene are described more particularly in WO-A 94/24231.

Further particular additives comprising monoamino groups (Da) are the hydrogenation products of the reaction products of polyisobutenes having an average degree of polymerization P=5 to 100 with nitrogen oxides or mixtures of nitrogen oxides and oxygen, as described more particularly in WO-A 97/03946.

Further particular additives comprising monoamino groups (Da) are the compounds obtainable from polyisobutene epoxides by reaction with amines and subsequent dehydration and reduction of the amino alcohols, as described more particularly in DE-A 196 20 262.

Additives comprising nitro groups (Db), optionally in combination with hydroxyl groups, are preferably reaction products of polyisobutenes having an average degree of polymerization P=5 to 100 or 10 to 100 with nitrogen oxides or mixtures of nitrogen oxides and oxygen, as described more particularly in WO-A 96/03367 and in WO-A 96/03479. These reaction products are generally mixtures of pure nitropolyisobutenes (e.g. α,β-dinitropolyisobutene) and mixed hydroxynitropolyisobutenes (e.g. α-nitro-β-hydroxypolyisobutene).

Additives comprising hydroxyl groups in combination with mono- or polyamino groups (Dc) are especially reaction products of polyisobutene epoxides obtainable from polyisobutene having preferably predominantly terminal double bonds and $M_n$=300 to 5000, with ammonia or mono- or polyamines, as described more particularly in EP-A 476 485.

Additives comprising carboxyl groups or their alkali metal or alkaline earth metal salts (Dd) are preferably copolymers of $C_2$- to $C_{40}$-olefins with maleic anhydride which have a total molar mass of 500 to 20 000 and some or all of whose carboxyl groups have been converted to the alkali metal or alkaline earth metal salts and any remainder of the carboxyl groups has been reacted with alcohols or amines. Such additives are disclosed more particularly by EP-A 307 815. Such additives serve mainly to prevent valve seat wear and can, as described in WO-A 87/01126, advantageously be used in combination with customary fuel detergents such as poly(iso) buteneamines or polyetheramines.

Additives comprising sulfonic acid groups or their alkali metal or alkaline earth metal salts (De) are preferably alkali metal or alkaline earth metal salts of an alkyl sulfosuccinate, as described more particularly in EP-A 639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (Df) are preferably polyethers or polyetheramines which are obtainable by reaction of $C_2$- to $C_{60}$-alkanols, $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkyl phenols with 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described more particularly in EP-A 310 875, EP-A 356 725, EP-A 700 985 and U.S. Pat. No. 4,877,416. In the case of polyethers, such products also have carrier oil properties. Typical examples thereof are tridecanol butoxylates or isotridecanol butoxylates, isononylphenol butoxylates and also polyisobutenol butoxylates and propoxylates, and also the corresponding reaction products with ammonia.

Additives comprising carboxylic ester groups (Dg) are preferably esters of mono-, di- or tricarboxylic acids with long-chain alkanols or polyols, especially those having a minimum viscosity of 2 $mm^2/s$ at 100° C., as described more particularly in DE-A 38 38 918. The mono-, di- or tricarboxylic acids used may be aliphatic or aromatic acids, and particularly suitable ester alcohols or ester polyols are long-chain representatives having, for example, 6 to 24 carbon atoms. Typical representatives of the esters are adipates, phthalates, isophthalates, terephthalates and trimellitates of isooctanol, of isononanol, of isodecanol and of isotridecanol. Such products also satisfy carrier oil properties.

Additives comprising moieties derived from succinic anhydride and having hydroxyl and/or amino and/or amido and/or especially imido groups (Dh) are preferably corresponding derivatives of alkyl- or alkenyl-substituted succinic anhydride and especially the corresponding derivatives of polyisobutenylsuccinic anhydride which are obtainable by reacting conventional or high-reactivity polyisobutene having $M_n$=preferably 300 to 5000, more preferably 300 to 3000, even more preferably 500 to 2500, even more especially preferably 700 to 2500 and especially 800 to 1500, with maleic anhydride by a thermal route in an ene reaction or via the chlorinated polyisobutene. The moieties having hydroxyl and/or amino and/or amido and/or imido groups are, for example, carboxylic acid groups, acid amides of monoamines, acid amides of di- or polyamines which, in addition to the amide function, also have free amine groups, succinic acid derivatives having an acid and an amide function, carboximides with monoamines, carboximides with di- or polyamines which, in addition to the imide function, also have free amine groups, or diimides which are formed by the reaction of di- or polyamines with two succinic acid derivatives. Such fuel additives are described more particularly in U.S. Pat. No. 4,849,572. They are preferably the reaction products of alkyl- or alkenyl-substituted succinic acids or derivatives thereof with amines and more preferably the reaction products of polyisobutenyl-substituted succinic acids or derivatives thereof with amines. Of particular interest in this context are reaction products with aliphatic polyamines (polyalkyleneimines) such as especially ethylenediamine, diethylenetriamine, triethylenetetramine, tetraethylenepentamine, pentaethylenehexamine and hexaethyleneheptamine, which have an imide structure.

Additives comprising moieties (Di) obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or high-reactivity polyisobutene having $M_n$=300 to 5000. Such "polyisobutene Mannich bases" are described more particularly in EP-A 831 141.

One or more of the detergent additives from groups (Da) to (Di) mentioned can be added to the fuel in such an amount that the dosage of these detergent additives is preferably 25 to 2500 ppm by weight, especially 75 to 1500 ppm by weight, in particular 150 to 1000 ppm by weight.

Carrier oils additionally used as a coadditive may be of mineral or synthetic nature. Suitable mineral carrier oils are fractions obtained in crude oil processing, such as brightstock or base oils having viscosities, for example, from the SN 500-2000 class; but also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of the abovementioned mineral carrier oils.

Examples of suitable synthetic carrier oils are polyolefins (polyalphaolefins or polyinternalolefins), (poly)esters, (poly) alkoxylates, polyethers, aliphatic polyether-amines, alkylphenol-started polyethers, alkylphenol-started polyetheramines and carboxylic esters of long-chain alkanols.

Examples of suitable polyolefins are olefin polymers having $M_n$=400 to 1800, in particular based on polybutene or polyisobutene (hydrogenated or unhydrogenated).

Examples of suitable polyethers or polyetheramines are preferably compounds comprising polyoxy-$C_2$- to $C_4$-alkylene moieties which are obtainable by reacting $C_2$- to $C_{60}$-alkanols, $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkylphenols with 1 to 30 mol of ethylene oxide and/or propylene oxide and/or butylene oxide per hydroxyl group or amino group, and, in the case of the polyetheramines, by subsequent reductive amination with ammonia, monoamines or polyamines. Such products are described more particularly in EP-A 310 875, EP-A 356 725, EP-A 700 985 and U.S. Pat. No. 4,877,416. For example, the polyetheramines used may be poly-$C_2$- to $C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are more particularly esters of mono-, di- or tricarboxylic acids with long-chain alkanols or polyols, as described more particularly in DE-A 38 38 918. The mono-, di- or tricarboxylic acids used may be aliphatic or aromatic acids; particularly suitable ester alcohols or ester polyols are long-chain representatives having, for example, 6 to 24 carbon atoms. Typical representatives of the esters are adipates, phthalates, isophthalates, terephthalates and trimellitates of isooctanol, isononanol, isodecanol and isotridecanol, for example di(n- or isotridecyl) phthalate.

Further suitable carrier oil systems are described, for example, in DE-A 38 26 608, DE-A 41 42 241, DE-A 43 09 074, EP-A 452 328 and EP-A 548 617.

Examples of particularly suitable synthetic carrier oils are alcohol-started polyethers having about 5 to 35, preferably about 5 to 30, more preferably 10 to 30 and especially 15 to 30 $C_3$- to $C_6$-alkylene oxide units, for example propylene oxide, n-butylene oxide and isobutylene oxide units, or mixtures thereof, per alcohol molecule. Nonlimiting examples of suitable starter alcohols are long-chain alkanols or phenols substituted by long-chain alkyl in which the long-chain alkyl radical is especially a straight-chain or branched $C_6$- to $C_{18}$-alkyl radical. Particular examples include tridecanol and nonylphenol. Particularly preferred alcohol-started polyethers are the reaction products (polyetherification products) of monohydric aliphatic $C_6$- to $C_{18}$-alcohols with $C_3$- to $C_6$-alkylene oxides. Examples of monohydric aliphatic $C_6$-$C_{18}$-alcohols are hexanol, heptanol, octanol, 2-ethylhexanol, nonyl alcohol, decanol, 2-propylheptanol, undecanol, dodecanol, tridecanol, tetradecanol, pentadecanol, hexadecanol, octadecanol and the constitutional and positional isomers thereof. The alcohols can be used either in the form of the pure isomers or in the form of technical grade mixtures. A particularly preferred alcohol is tridecanol. Examples of $C_3$- to $C_6$-alkylene oxides are propylene oxide, such as 1,2-propylene oxide, butylene oxide, such as 1,2-butylene oxide, 2,3-butylene oxide, isobutylene oxide or tetrahydrofuran, pentylene oxide and hexylene oxide. Particular preference among these is given to $C_3$- to $C_4$-alkylene oxides, i.e. propylene oxide such as 1,2-propylene oxide and butylene oxide such as 1,2-butylene oxide, 2,3-butylene oxide and isobutylene oxide. Especially butylene oxide is used.

Further suitable synthetic carrier oils are alkoxylated alkylphenols, as described in DE-A 10 102 913.

Particular carrier oils are synthetic carrier oils, particular preference being given to the above-described alcohol-started polyethers.

The carrier oil or the mixture of different carrier oils is added to the fuel in an amount of preferably 1 to 1000 ppm by weight, more preferably of 10 to 500 ppm by weight and especially of 20 to 100 ppm by weight.

Cold flow improvers suitable as coadditives are in principle all organic compounds which are capable of improving the flow performance of middle distillate fuels or diesel fuels under cold conditions. For the intended purpose, they must have sufficient oil solubility. More particularly, useful cold flow improvers for this purpose are the cold flow improvers (middle distillate flow improvers, MDFIs) typically used in the case of middle distillates of fossil origin, i.e. in the case of customary mineral diesel fuels. However, it is also possible to use organic compounds which partly or predominantly have the properties of a wax antisettling additive (WASA) when used in customary diesel fuels. The imidazolium salts (I) used in accordance with the invention, in middle distillate fuels, especially in diesel fuels, themselves have properties as WASAs, which is of course also subject matter of the present invention. Coadditives used as cold flow improvers can also act partly or predominantly as nucleators. It is also possible to use mixtures of organic compounds effective as MDFIs and/or effective as WASAs and/or effective as nucleators.

The cold flow improver is typically selected from (K1) copolymers of a $C_2$- to $C_{40}$-olefin with at least one further ethylenically unsaturated monomer;

(K2) comb polymers;

(K3) polyoxyalkylenes;

(K4) polar nitrogen compounds;

(K5) sulfocarboxylic acids or sulfonic acids or derivatives thereof; and (K6) poly(meth)acrylic esters.

It is possible to use either mixtures of different representatives from one of the particular classes (K1) to (K6) or mixtures of representatives from different classes (K1) to (K6).

Suitable $C_2$- to $C_{40}$-olefin monomers for the copolymers of class (K1) are, for example, those having 2 to 20 and especially 2 to 10 carbon atoms, and 1 to 3 and preferably 1 or 2 carbon-carbon double bonds, especially having one carbon-carbon double bond. In the latter case, the carbon-carbon double bond may be arranged either terminally α-olefins) or internally. However, preference is given to α-olefins, particular preference to α-olefins having 2 to 6 carbon atoms, for example propene, 1-butene, 1-pentene, 1-hexene and in particular ethylene.

In the copolymers of class (K1), the at least one further ethylenically unsaturated monomer is preferably selected from alkenyl carboxylates, (meth)acrylic esters and further olefins.

When further olefins are also copolymerized, they are preferably higher in molecular weight than the abovementioned $C_2$- to $C_{40}$-olefin base monomer. When, for example, the olefin base monomer used is ethylene or propene, suitable further olefins are especially $C_{10}$- to $C_{40}$-α-olefins. Further olefins are in most cases only additionally copolymerized when monomers with carboxylic ester functions are also used.

Suitable (meth)acrylic esters are, for example, esters of (meth)acrylic acid with $C_1$- to $C_{20}$-alkanols, especially $C_1$- to $C_{10}$-alkanols, in particular with methanol, ethanol, propanol, isopropanol, n-butanol, sec-butanol, isobutanol, tert-butanol, pentanol, hexanol, heptanol, octanol, 2-ethylhexanol, nonanol and decanol, and structural isomers thereof.

Suitable alkenyl carboxylates are, for example, $C_2$- to $C_{14}$-alkenyl esters, for example the vinyl and propenyl esters, of carboxylic acids having 2 to 21 carbon atoms, whose hydrocarbyl radical may be linear or branched. Among these, preference is given to the vinyl esters. Among the carboxylic acids with a branched hydrocarbyl radical, preference is given to those whose branch is in the α position to the carboxyl group, and the α-carbon atom is more preferably tertiary, i.e. the carboxylic acid is what is called a neocarboxylic acid. However, the hydrocarbyl radical of the carboxylic acid is preferably linear.

Examples of suitable alkenyl carboxylates are vinyl acetate, vinyl propionate, vinyl butyrate, vinyl 2-ethylhexanoate, vinyl neopentanoate, vinyl hexanoate, vinyl neononanoate, vinyl neodecanoate and the corresponding propenyl esters, preference being given to the vinyl esters. A particularly preferred alkenyl carboxylate is vinyl acetate; typical copolymers of group (K1) resulting therefrom are ethylene-vinyl acetate copolymers ("EVAs"), which are some of the most frequently used.

Ethylene-vinyl acetate copolymers usable particularly advantageously and the preparation thereof are described in WO 99/29748.

Suitable copolymers of class (K1) are also those which comprise two or more different alkenyl carboxylates in copolymerized form, which differ in the alkenyl function and/or in the carboxylic acid group. Likewise suitable are copolymers which, as well as the alkenyl carboxylate(s), comprise at least one olefin and/or at least one (meth)acrylic ester in copolymerized form.

Terpolymers of a $C_2$- to $C_{40}$-α-olefin, a $C_1$- to $C_{20}$-alkyl ester of an ethylenically unsaturated monocarboxylic acid having 3 to 15 carbon atoms and a $C_2$- to $C_{14}$-alkenyl ester of a saturated monocarboxylic acid having 2 to 21 carbon atoms are also suitable as copolymers of class (K1). Terpolymers of this kind are described in WO 2005/054314. A typical terpolymer of this kind is formed from ethylene, 2-ethylhexyl acrylate and vinyl acetate.

The at least one or the further ethylenically unsaturated monomer(s) are copolymerized in the copolymers of class (K1) in an amount of preferably 1 to 50% by weight, especially 10 to 45% by weight and in particular 20 to 40% by weight, based on the overall copolymer. The main proportion in terms of weight of the monomer units in the copolymers of class (K1) therefore originates generally from the $C_2$- to $C_{40}$ base olefins.

The copolymers of class (K1) preferably have a number-average molecular weight $M_n$ of 1000 to 20 000, more preferably of 1000 to 10 000 and especially of 1000 to 8000.

Typical comb polymers of component (K2) are, for example, obtainable by the copolymerization of maleic anhydride or fumaric acid with another ethylenically unsaturated monomer, for example with an α-olefin or an unsaturated ester, such as vinyl acetate, and subsequent esterification of the anhydride or acid function with an alcohol having at least 10 carbon atoms. Further suitable comb polymers are copolymers of α-olefins and esterified comonomers, for example esterified copolymers of styrene and maleic anhydride or esterified copolymers of styrene and fumaric acid. Suitable comb polymers may also be polyfumarates or polymaleates. Homo- and copolymers of vinyl ethers are also suitable comb polymers. Comb polymers suitable as components of class (K2) are, for example, also those described in WO 2004/035715 and in "Comb-Like Polymers. Structure and Properties", N. A. Plate and V. P. Shibaev, J. Poly. Sci. Macromolecular Revs. 8, pages 117 to 253 (1974). Mixtures of comb polymers are also suitable.

Polyoxyalkylenes suitable as components of class (K3) are, for example, polyoxyalkylene esters, polyoxyalkylene ethers, mixed polyoxyalkylene ester/ethers and mixtures thereof. These polyoxyalkylene compounds preferably comprise at least one linear alkyl group, preferably at least two linear alkyl groups, each having 10 to 30 carbon atoms and a polyoxyalkylene group having a number-average molecular weight of up to 5000. Such polyoxyalkylene compounds are described, for example, in EP A 061 895 and also in U.S. Pat. No. 4,491,455. Particular polyoxyalkylene compounds are based on polyethylene glycols and polypropylene glycols having a number-average molecular weight of 100 to 5000. Additionally suitable are polyoxyalkylene mono- and diesters of fatty acids having 10 to 30 carbon atoms, such as stearic acid or behenic acid.

Polar nitrogen compounds suitable as components of class (K4) may be either ionic or nonionic and preferably have at least one substituent, especially at least two substituents, in the form of a tertiary nitrogen atom of the general formula $>NR^7$ in which $R^7$ is a $C_8$- to $C_{40}$-hydrocarbyl radical. The nitrogen substituents may also be quaternized, i.e. be in cationic form. An example of such nitrogen compounds is that of ammonium salts and/or amides which are obtainable by the reaction of at least one amine substituted by at least one hydrocarbyl radical with a carboxylic acid having 1 to 4 carboxyl groups or with a suitable derivative thereof. The amines preferably comprise at least one linear $C_8$- to $C_{40}$-alkyl radical. Primary amines suitable for preparing the polar nitrogen compounds mentioned are, for example, octylamine, nonylamine, decylamine, undecylamine, dodecylamine, tetradecylamine and the higher linear homologs; secondary amines suitable for this purpose are, for example, dioctadecylamine and methylbehenylamine. Also suitable for this purpose are amine mixtures, especially amine mixtures obtainable on the industrial scale, such as fatty amines or hydrogenated tallamines, as described, for example, in Ullmann's Encyclopedia of Industrial Chemistry, 6th Edition, "Amines, aliphatic" chapter. Acids suitable for the reaction are, for example, cyclohexane-1,2-dicarboxylic acid, cyclohexene-1,2-dicarboxylic acid, cyclopentane-1,2-dicarboxylic acid, naphthalenedicarboxylic acid, phthalic acid, isophthalic acid, terephthalic acid, and succinic acids substituted by long-chain hydrocarbyl radicals.

More particularly, the component of class (K4) is an oil-soluble reaction product of poly($C_2$- to $C_{20}$-carboxylic acids) having at least one tertiary amino group with primary or secondary amines. The poly($C_2$- to $C_{20}$-carboxylic acids) which have at least one tertiary amino group and form the basis of this reaction product comprise preferably at least 3 carboxyl groups, especially 3 to 12 and in particular 3 to 5 carboxyl groups. The carboxylic acid units in the polycarboxylic acids have preferably 2 to 10 carbon atoms, and are especially acetic acid units. The carboxylic acid units are suitably bonded to the polycarboxylic acids, usually via one or more carbon and/or nitrogen atoms. They are preferably attached to tertiary nitrogen atoms which, in the case of a plurality of nitrogen atoms, are bonded via hydrocarbon chains.

The component of class (K4) is preferably an oil-soluble reaction product based on poly($C_2$- to $C_{20}$-carboxylic acids) which have at least one tertiary amino group and are of the general formula IIa or IIb (IIa)

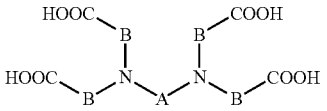

(IIb)

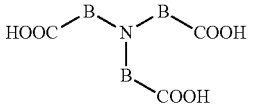

in which the variable A is a straight-chain or branched $C_2$- to $C_6$-alkylene group or the moiety of the formula III (III)

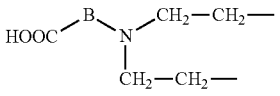

and the variable B is a $C_1$- to $C_{19}$-alkylene group. The compounds of the general formulae IIa and IIb especially have the properties of a WASA.

Moreover, the preferred oil-soluble reaction product of component (K4), especially that of the general formula IIa or IIb, is an amide, an amide-ammonium salt or an ammonium salt in which no, one or more carboxylic acid groups have been converted to amide groups.

Straight-chain or branched $C_2$- to $C_6$-alkylene groups of the variable A are, for example, 1,1-ethylene, 1,2-propylene, 1,3-propylene, 1,2-butylene, 1,3-butylene, 1,4-butylene, 2-methyl-1,3-propylene, 1,5-pentylene, 2-methyl-1,4-butylene, 2,2-dimethyl-1,3-propylene, 1,6-hexylene (hexamethylene) and especially 1,2-ethylene. The variable A comprises preferably 2 to 4 and especially 2 or 3 carbon atoms.

$C_1$- to $C_{19}$-alkylene groups of the variable B are, for example, 1,2-ethylene, 1,3-propylene, 1,4-butylene, hexamethylene, octamethylene, decamethylene, dodecamethylene, tetradecamethylene, hexadecamethylene, octadecamethylene, nonadecamethylene and especially methylene. The variable B comprises preferably 1 to 10 and especially 1 to 4 carbon atoms.

The primary and secondary amines as a reaction partner for the polycarboxylic acids to form component (K4) are typically monoamines, especially aliphatic monoamines. These primary and secondary amines may be selected from a multitude of amines which bear hydrocarbyl radicals which may optionally be bonded to one another.

These parent amines of the oil-soluble reaction products of component (K4) are usually secondary amines and have the general formula $HN(R^8)_2$ in which the two variables $R^8$ are each independently straight-chain or branched $C_{10}$- to $C_{30}$-alkyl radicals, especially $C_{14}$- to $C_{24}$-alkyl radicals. These relatively long-chain alkyl radicals are preferably straight-chain or only slightly branched. In general, the secondary amines mentioned, with regard to their relatively long-chain alkyl radicals, derive from naturally occurring fatty acids and from derivatives thereof. The two $R^8$ radicals are preferably the same.

The secondary amines mentioned may be bonded to the polycarboxylic acids by means of amide structures or in the form of the ammonium salts; it is also possible for only a portion to be present as amide structures and another portion as ammonium salts. Preferably only few, if any, free acid groups are present. The oil-soluble reaction products of component (K4) are preferably present completely in the form of the amide structures.

Typical examples of such components (K4) are reaction products of nitrilotriacetic acid, of ethylenediaminetetraacetic acid or of propylene-1,2-diaminetetraacetic acid with in each case 0.5 to 1.5 mol per carboxyl group, especially 0.8 to 1.2 mol per carboxyl group, of dioleylamine, dipalmitamine, dicocoamine, distearylamine, dibehenylamine or especially ditallamine. A particularly preferred component (K4) is the reaction product of 1 mol of ethylenediaminetetraacetic acid and 4 mol of hydrogenated ditallamine.

Further typical examples of component (K4) include the N,N-dialkylammonium salts of 2-N',N'-dialkylamidobenzoates, for example the reaction product of 1 mol of phthalic anhydride and 2 mol of ditallamine, the latter being hydrogenated or unhydrogenated, and the reaction product of 1 mol of an alkenylspirobislactone with 2 mol of a dialkylamine, for example ditallamine and/or tallamine, the latter two being hydrogenated or unhydrogenated.

Further typical structure types for the component of class (K4) are cyclic compounds with tertiary amino groups or condensates of long-chain primary or secondary amines with carboxylic acid-containing polymers, as described in WO 93/18115.

Sulfocarboxylic acids, sulfonic acids or derivatives thereof which are suitable as cold flow improvers of the component of class (K5) are, for example, the oil-soluble carboxamides and carboxylic esters of ortho-sulfobenzoic acid, in which the sulfonic acid function is present as a sulfonate with alkyl-substituted ammonium cations, as described in EP-A 261 957.

Poly(meth)acrylic esters suitable as cold flow improvers of the component of class (KG) are either homo- or copolymers of acrylic and methacrylic esters. Preference is given to copolymers of at least two different (meth)acrylic esters which differ with regard to the esterified alcohol. The copolymer optionally comprises another different olefinically unsaturated monomer in copolymerized form. The weight-average molecular weight of the polymer is preferably 50 000 to 500 000. A particularly preferred polymer is a copolymer of methacrylic acid and methacrylic esters of saturated $C_{14}$- and $C_{15}$-alcohols, the acid groups having been neutralized with hydrogenated tallamine. Suitable poly(meth)acrylic esters are described, for example, in WO 00/44857.

The cold flow improver or the mixture of different cold flow improvers is added to the middle distillate fuel or diesel fuel in a total amount of preferably 10 to 5000 ppm by weight, more preferably of 20 to 2000 ppm by weight, even more preferably of 50 to 1000 ppm by weight and especially of 100 to 700 ppm by weight, for example of 200 to 500 ppm by weight.

Lubricity improvers or friction modifiers suitable as coadditives are based typically on fatty acids or fatty acid esters. Typical examples are tall oil fatty acid, as described, for example, in WO 98/004656, and glyceryl monooleate. The reaction products, described in U.S. Pat. No. 6,743,266 B2, of natural or synthetic oils, for example triglycerides, and alkanolamines are also suitable as such lubricity improvers.

Corrosion inhibitors suitable as coadditives are, for example, succinic esters, in particular with polyols, fatty acid derivatives, for example oleic esters, oligomerized fatty acids, substituted ethanolamines, N-acylated sarcosine, imidazoline derivatives, for example those which bear an alkyl group in the 2 position and a functional organic radical on the trivalent nitrogen atom (a typical imidazoline derivative of this kind is the reaction product of excess oleic acid with diethylenetriamine), and products which are sold under the trade names RC 4801 (Rhein Chemie Mannheim, Germany) or HiTEC 536 (Ethyl Corporation). The imidazoline derivatives mentioned are particularly effective as corrosion inhibitors when they are combined in this application with one or more carboxamides having one or more carboxamide functions in the molecule and having relatively long-chain radicals on the amide nitrogens, for example with the reaction product of maleic anhydride with a long-chain amine in an equimolar ratio.

Demulsifiers suitable as coadditives are, for example, the alkali metal or alkaline earth metal salts of alkyl-substituted phenol- and naphthalenesulfonates and the alkali metal or alkaline earth metal salts of fatty acids, and also neutral compounds such as alcohol alkoxylates, e.g. alcohol ethoxylates, phenol alkoxylates, e.g. tert-butylphenol ethoxylate or tert-pentylphenol ethoxylate, fatty acids, alkylphenols, condensation products of ethylene oxide (EO) and propylene oxide (PO), for example including in the form of EO/PO block copolymers, polyethyleneimines or else polysiloxanes.

Dehazers suitable as coadditives are, for example, alkoxylated phenol-formaldehyde condensates, for example the products available under the trade names NALCO 7D07 (Nalco) and TOLAD 2683 (Petrolite).

Antifoams suitable as coadditives are, for example, polyether-modified polysiloxanes, for example the products available under the trade names TEGOPREN 5851 (Goldschmidt), Q 25907 (Dow Corning) and RHODOSIL (Rhone Poulenc).

Cetane number improvers suitable as coadditives are, for example, aliphatic nitrates such as 2-ethylhexyl nitrate and cyclohexyl nitrate and peroxides such as di-tert-butyl peroxide.

Antioxidants suitable as coadditives are, for example, substituted, i.e. sterically hindered phenols, such as 2,6-di-tert-butylphenol, 2,6-di-tert-butyl-3-methylphenol or products sold under the IRGANOX® (BASF SE) trade name, for example 2,6-di-tert-butyl-4-alkoxycarbonylethylphenol (IRGANOX L135), and also phenylenediamines such as N,N'-di-sec-butyl-p-phenylenediamine.

Metal deactivators suitable as coadditives are, for example, salicylic acid derivatives such as N,N'-disalicylidene-1,2-propanediamine or products sold under the IRGAMET® (BASF SE) trade name, based on N-substituted triazoles and tolutriazoles.

Suitable solvents to be used in addition are, for example, nonpolar organic solvents such as aromatic and aliphatic hydrocarbons, for example toluene, xylenes, white spirit and products which are sold under the SHELLSOL (Royal Dutch/Shell Group) and EXXSOL (ExxonMobil) trade names, and also polar organic solvents, for example alcohols such as 2-ethylhexanol, decanol and isotridecanol, and carboxylic esters with relatively long-chain alkyl groups, such as $C_{12}$- to $C_{20}$-fatty acid methyl ester. Such solvents are usually added to the fuel, especially the diesel fuel, together with the imidazolium salts (I) and the aforementioned coadditives, which they are intended to dissolve or dilute for better handling.

The imidazolium salts (I) for use in accordance with the invention are outstandingly suitable as a fuel additive and can in principle be used in any fuels. They bring about a whole series of advantageous effects in the operation of internal combustion engines with fuels. The imidazolium salts (I) for use in accordance with the invention are preferably used in middle distillate fuels, especially diesel fuels.

The present invention therefore also provides a fuel composition, especially a middle distillate fuel composition, with a content of the imidazolium salts (I) to be used in accordance with the invention which is effective as an additive for achieving advantageous effects in the operation of internal combustion engines, for example of diesel engines, especially of direct injection diesel engines, in particular of diesel engines with common rail injection systems, alongside the majority of a customary base fuel. This effective content (dosage) is generally 10 to 5000 ppm by weight, preferably 20 to 1500 ppm by weight, especially 25 to 1000 ppm by weight, in particular 30 to 750 ppm by weight, based in each case on the total amount of fuel.

Middle distillate fuels such as diesel fuels or heating oils are preferably mineral oil raffinates which typically have a boiling range from 100 to 400° C. These are usually distillates having a 95% point up to 360° C. or even higher. These may also be what is called "ultra low sulfur diesel" or "city diesel", characterized by a 95% point of, for example, not more than 345° C. and a sulfur content of not more than 0.005% by weight or by a 95% point of, for example, 285° C. and a sulfur content of not more than 0.001% by weight. In addition to the mineral middle distillate fuels or diesel fuels obtainable by refining, those obtainable by coal gasification or gas liquefaction ["gas to liquid" (GTL) fuels] or by biomass liquefaction ["biomass to liquid" (BTL) fuels] are also suitable. Also suitable are mixtures of the aforementioned middle distillate fuels or diesel fuels with renewable fuels, such as biodiesel or bioethanol.

The qualities of the heating oils and diesel fuels are laid down in detail, for example, in DIN 51603 and EN 590 (cf. also Ullmann's Encyclopedia of Industrial Chemistry, 5th edition, Volume A12, p. 617 ff.).

In addition to the use thereof in the abovementioned middle distillate fuels of fossil, vegetable or animal origin, which are essentially hydrocarbon mixtures, the imidazolium salts (I) for use in accordance with the invention can also be used in mixtures of such middle distillates with biofuel oils (biodiesel). Such mixtures are also encompassed by the term "middle distillate fuel" in the context of the present invention. They are commercially available and usually comprise the biofuel oils in minor amounts, typically in amounts of 1 to 30% by weight, especially of 3 to 10% by weight, based on the total amount of middle distillate of fossil, vegetable or animal origin and biofuel oil.

Biofuel oils are generally based on fatty acid esters, usually essentially on alkyl esters of fatty acids which derive from vegetable and/or animal oils and/or fats. Alkyl esters are typically understood to mean lower alkyl esters, especially $C_1$-$C_4$-alkyl esters, which are obtainable by transesterifying the glycerides which occur in vegetable and/or animal oils and/or fats, especially triglycerides, by means of lower alcohols, for example ethanol or in particular methanol ("FAME"). Typical lower alkyl esters based on vegetable and/or animal oils and/or fats, which find use as a biofuel oil or components thereof, are, for example, sunflower methyl ester, palm oil methyl ester ("PME"), soya oil methyl ester ("SME") and especially rapeseed oil methyl ester ("RME").

The middle distillate fuels or diesel fuels are more preferably those having a low sulfur content, i.e. having a sulfur content of less than 0.05% by weight, preferably of less than 0.02% by weight, more particularly of less than 0.005% by weight and especially of less than 0.001% by weight of sulfur.

Useful gasoline fuels include all commercial gasoline fuel compositions. One typical representative which shall be mentioned here is the Eurosuper base fuel to EN 228, which is customary on the market. In addition, gasoline fuel compositions of the specification according to WO 00/47698 are also possible fields of use for the present invention.

The present invention also provides an additive concentrate which, in combination with at least one further fuel additive, especially with at least one further diesel fuel additive, comprises at least one imidazolium salt (I) for use in accordance with the invention. Typically, such an additive concentrate comprises 10 to 60% by weight of at least one solvent or diluent, which may be an abovementioned solvent or the fuel itself. The inventive additive concentrate preferably comprises, as well as the at least one imidazolium salt (I) for use in accordance with the invention, at least one detergent additive from the abovementioned group (Da) to (Di), especially at least one detergent additive of the (Dh) type, and generally additionally also at least one lubricity improver and/or a corrosion inhibitor and/or a demulsifier and/or a dehazer and/or an antifoam and/or a cetane number improver and/or an antioxidant and/or a metal deactivator, in the relative amounts customary therefor in each case.

The imidazolium salts (I) for use in accordance with the invention are especially suitable as an additive in fuel compositions, especially in diesel fuels, for overcoming the problems outlined at the outset in direct injection diesel engines, in particular in those with common rail injection systems.

Since some of the imidazolium salts described are novel substances, the present invention likewise provides imidazolium salts of the general formula (Ia)

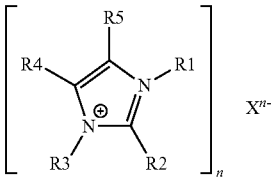

(Ia)

in which one of the variables R1 and R3 is or both variables R1 and R3 are independently a linear alkyl or alkenyl radical having 14 to 3000 carbon atoms or a branched alkyl or alkenyl radical having 4 to 3000 carbon atoms, the variable R1 or R3 which is not a linear alkyl or alkenyl radical having 14 to 3000 carbon atoms or a branched alkyl or alkenyl radical having 4 to 3000 carbon atoms is an alkyl radical having 1 to 13 carbon atoms or an alkenyl radical having 2 to 13 carbon atoms, the variables R2, R4 and R5 are each independently hydrogen, an alkyl radical having 1 to 20 carbon atoms or an alkenyl radical having 2 to 20 carbon atoms, X is an anion and n is the number 1, 2 or 3, where the said variables R1 to R5, X and n each have the abovementioned relevant individual definitions and preferred ranges.

Particularly preferred imidazolium salts of the general formula (Ia) are those in which one of the variables R1 and R3 is or both variables R1 and R3 are independently a linear alkyl or alkenyl radical having 14 to 20 carbon atoms or a branched alkyl or alkenyl radical having 4 to 13 carbon atoms, and the variables R2, R4 and R5 are each independently hydrogen, an alkyl radical having 1 to 20 carbon atoms or an alkenyl radical having 2 to 20 carbon atoms.

Particularly preferred imidazolium salts of the general formula (Ia) are additionally those in which one of the variables R1 and R3 is or both variables R1 and R3 are independently a polyisobutyl radical having a number-average molecular weight of 200 to 40 000, and the variables R2, R4 and R5 are each independently hydrogen, an alkyl radical having 1 to 20 carbon atoms or an alkenyl radical having 2 to 20 carbon atoms.

The novel imidazolium salts of the general formula (Ia) are suitable, as well as their possible use as additives for fuels, especially as detergent additives for diesel fuels, also for improvement of the use properties of mineral and synthetic nonaqueous industrial fluids. Nonaqueous industrial fluids, which in individual cases may comprise water components, but the essential effect of which is based on nonaqueous components, shall be understood here to mean lubricants, lubricant compositions and lubricant oils in the widest sense, especially motor oils, transmission oils, axle oils, hydraulic fluids, hydraulic oils, compressor fluids, compressor oils, circulation oils, turbine oils, transformer oils, gas motor oils, wind turbine oils, slideway oils, lubricant greases, cooling lubricants, antiwear oils for chains and conveyor systems, metalworking fluids, food-compatible lubricants for the industrial processing of foods, and boiler oils for industrial cookers, sterilizers and steam peelers. Use properties which are improved by the imidazolium salts (Ia) are especially lubricity, frictional wear, lifetime, corrosion protection, antimicrobial protection, demulsification capacity with regard to easier removal of water and impurities, and filterability.

The invention is now illustrated in detail by the working examples which follow:

EXAMPLES

Preparation of 1,3-di(2-ethylhexyl)imidazolium acetate 300.3 g (3.0 mol) of a 30% by weight aqueous formaldehyde solution, 435.3 g (3.0 mol) of glyoxal and 180.2 g (3.0 mol) of anhydrous acetic acid were initially charged in a flask, and 791.3 g (6.0 mol) of 98% by weight 2-ethylhexylamine were gradually added thereto at room temperature, while stirring. In the course of this, the temperature of the reaction mixture rose rapidly to 38° C. and was kept there by ice bath cooling until the addition of the amine had ended. This was followed by stirring at 80° C. for 5 hours. After removing the upper aqueous phase, 1038.4 g of 1,3-(2-ethylhexyl)imidazolium acetate were obtained.

Preparation of 1,3-di(polyisobutyl)imidazolium acetate

Analogously to the above-described preparation of 1,3-di(2-ethylhexyl)imidazolium acetate, 3.0 mol of 30% by weight aqueous formaldehyde solution, 3.0 mol of glyoxal, 3.0 mol of anhydrous acetic acid and 6.0 mol of polyisobutylamine $C_4H_9$—$(C_4H_8)_x$—$CH_2NH_2$ where x=17-18 (commercial product, Kerocom® PIBA from BASF SE) were used to obtain 1,3-di(polyisobutyl)imidazolium acetate.

USE EXAMPLES

To study the influence of the additives on the performance of direct injection diesel engines, the test method used was the DW10 engine test, in which the power loss was determined by injector deposits in the common rail diesel engine, based on the official test method CEC F-098-08.

The power loss is a direct measure of formation of deposits in the injectors.

A direct injection diesel engine with common rail system according to test method CEC F-098-08 was used. The fuel used was a commercial diesel fuel from Halternann (DF-79-07/5). To artificially induce the formation of deposits at the injectors, 1 ppm by weight of zinc in the form of a zinc didodecanoate solution was added thereto. The results illustrate the relative power loss at 4000 rpm, measured during sustained operation over 12 hours. The value "t0" indicates the power in kW at the start of the test, and the value "t12" the power in kW at the end of the test.

The following imidazolium salts were used as additives for use in accordance with invention:

(I.1) 1-ethyl-3-methylimidazolium acetate (I.2) 1-butyl-3-methylimidazolium acetate (I.3) 1-octyl-3-methylimidazolium methylcarbonate (I.4) 1,3-di(2-ethylhexyl)imidazolium acetate Compounds (I.1) and (I.2) are commercial products; compound (I.3) was prepared from N-octylimidazole by quaternization with dimethyl carbonate as a 30% by weight solution in methanol by a customary synthesis method; compound (I.4) was prepared by the synthesis method specified above.

In the test runs performed, additives (I.1) and (I.2) were used as pure substances and additives (I.3) and (I.4) as solutions. The dosages specified are based on the active ingredient.

The results of the power or power loss determinations of the DW10 engine test runs are compiled in the following table:

| Additive | Dosage [ppm by wt.] | t0 [kW] | t12 [kW] | power loss [%] |
|---|---|---|---|---|
| none | 0 | 93.9 | 88.8 | −5.4 |
| (I.1) | 100 | 98.9 | 98.0 | −0.9 |
| (I.2) | 100 | 97.1 | 97.0 | −0.1 |
| (I.2) | 30 | 95.2 | 94.4 | −0.8 |
| (I.3) | ..33 | 96.9 | 97.2 | +0.3 |
| (I.4) | 50 | 95.8 | 95.1 | −0.7 |

With additives (I.2) and (I.4), a soiling and cleaning run according to the DW10 test was additionally performed. For this purpose, the direct injection diesel engine with a common rail system used was first operated with the same commercial diesel fuel (with a content of 1 ppm by weight of zinc in the form of a zinc didodecanoate solution) without detergent additive for 12 hours, in the course of which the value t for the power in the experiment with (I.2) at first fell gradually from 96.2 kW to 89.8 kW. After addition of 30 ppm by weight of additive (I.2) and further operation for 5 hours, the value t for the power rose again to 95.7 kW, with the greatest jump for t within the first two hours after addition of (I.2) (after 1 hour t=91.4 kW, after 2 hours t=94.5 kW).

In experiment with additive (I.4), the power fell from 98.4 kW to 93.9 kW in the first 13 hours of operation without additive. After addition of 50 ppm by weight of additive (I.4) and further operation for 12 hours, the value t for the power rose again to 96.3 kW, with the greatest jump in power within the first two hours after addition of (I.4) (after further lowering of the value after the change of fuel to 92.8 kW, power rose after one hour back to t=94.5 kW, then after 2 hours to t=95.5 kW).

Additive (I.4) was also used to run a "keep clean" engine test according to test method CEC F-23-01 with the PSA XUD-9 A engine. The additive was used with a dosage of 50 ppm in a commercial diesel fuel from Halternann (DF-79-07/5). For comparison, the engine was operated in a separate test run with the same diesel fuel without additive. The flow restriction at 0.1 mm needle elevation in the fuel was 63% without additive, and −32% with 50 ppm by weight of additive (I.4).

The invention claimed is:

1. A method for increasing detergency in a diesel fuel, comprising:

adding a fuel additive to a non-aqueous diesel fuel comprising and in an effective amount of the fuel additive for, increased detergency thereof, wherein the fuel additive comprises an imidazolium salt of formula (I):

(I)

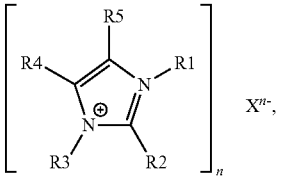

wherein R1 and R3 are each independently an organic radical having 1 to 3000 carbon atoms, R2, R4 and R5 are each independently hydrogen or an organic radical having 1 to 3000 carbon atoms, X is an anion selected from the group consisting of an alkylcarbonate, a pseudohalide, a carboxylate, and a tricyanomethanide anion, and n is 1, 2 or 3.

2. The method according to claim 1, wherein the fuel additive is an additive for reducing or preventing a deposit in an injection system of a direct injection diesel engine, for reducing fuel consumption of a direct injection diesel engine, and/or for minimizing power loss in a direct injection diesel engine.

3. The method according to claim 1, wherein R1 and R3 are each independently $C_1$- to $C_{20}$-alkyl groups, $C_2$- to $C_{20}$-alkenyl groups and/or polyisobutyl radicals having a number-average molecular weight of 200 to 40 000 and R2, R4 and R5 are each hydrogen.

4. The method according to claim 2, wherein the injection system is a common rail injection system.

5. The method according to claim 2, wherein the direct injection diesel engine is a diesel engine with a common rail injection system.

6. A method, comprising:

adding a fuel additive to a non-aqueous fuel, wherein the fuel additive comprises an imidazolium salt of formula (Ia):

(Ia)

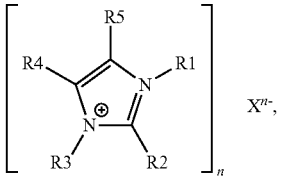

wherein at least one of R1 and R3 is independently a linear alkyl or alkenyl radical having 14 to 3000 carbon atoms or a branched alkyl or alkenyl radical having 4 to 3000 carbon atoms, wherein when R1 or R3 is not a linear alkyl or alkenyl radical having 14 to 3000 carbon atoms or a branched alkyl or alkenyl radical having 4 to 3000 carbon atoms, then R1 or R3 is an alkyl radical having 1 to 13 carbon atoms or an alkenyl radical having 2 to 13 carbon atoms, R2, R4 and R5 are each independently hydrogen, an alkyl radical having 1 to 20 carbon atoms or an alkenyl radical having 2 to 20 carbon atoms, X is an anion and n is 1,2 or 3.

7. The method according to claim 6, wherein at least one of R1 and R3 is independently a linear alkyl or alkenyl radical having 14 to 20 carbon atoms or a branched alkyl or alkenyl radical having 4 to 13 carbon atoms, and R2, R4 and R5 are each independently hydrogen, an alkyl radical having 1 to 20 carbon atoms or an alkenyl radical having 2 to 20 carbon atoms.

8. The method according to claim 6, wherein at least one of R1 and R3 is independently a polyisobutyl radical having a number-average molecular weight of 200 to 40 000, and R2, R4 and R5 are each independently hydrogen, an alkyl radical having 1 to 20 carbon atoms or an alkenyl radical having 2 to 20 carbon atoms.

9. The method according to claim 1, wherein the fuel additive is present in an amount of 10 to 5,000 ppm by weight of the fuel.

10. The method according to claim 1, wherein the fuel additive is present in an amount of 20 to 15,000 ppm by weight of the fuel.

11. The method according to claim 1, wherein the fuel additive is present in an amount of 25 to 1,000 ppm by weight of the fuel.

12. The method according to claim 1, wherein the fuel additive is present in an amount of 30 to 750 ppm by weight of the fuel.

13. The method according to claim 1, wherein the diesel fuel is a middle distillate fuel.

14. The method according to claim 1, wherein the diesel fuel is a mixture comprising a middle distillate and a biofuel oil.

15. The method according to claim 14, wherein the mixture has a sulfur content of less than 0.05% by weight.

16. The method according to claim 14, wherein the mixture has a sulfur content of less than 0.02% by weight.

17. The method according to claim 14, wherein the mixture has a sulfur content of less than 0.005% by weight.

18. The method according to claim 14, wherein the mixture has a sulfur content of less than 0.001% by weight.

* * * * *